US005078072A

United States Patent [19]

Horiuchi et al.

[11] Patent Number: 5,078,072

[45] Date of Patent: Jan. 7, 1992

[54] CATAMARAN

[75] Inventors: Kotaro Horiuchi; Keiji Nakagawa; Fumitaka Yokoyama, all of Iwata, Japan

[73] Assignee: Yamaha Hatsudoki Kabushiki Kaisha, Iwata, Japan

[21] Appl. No.: 703,591

[22] Filed: May 20, 1991

Related U.S. Application Data

[63] Continuation of Ser. No. 472,619, Jan. 30, 1990, abandoned.

[30] Foreign Application Priority Data

Jan. 31, 1989 [JP] Japan ..... 1-21981

[51] Int. Cl.[5] ..... B63H 9/06

[52] U.S. Cl. ..... 114/357; 114/61

[58] Field of Search ..... 114/56, 61, 123, 267, 114/343, 352, 355, 357; 156/242, 245, 264, 285, 62.2

[56] References Cited

U.S. PATENT DOCUMENTS

| | | | |
|---|---|---|---|
| 3,790,477 | 2/1974 | Bombardier | 114/357 |
| 4,094,027 | 6/1978 | Vernon | 114/357 |
| 4,478,166 | 10/1984 | Sorensen | 114/61 |
| 4,556,003 | 12/1985 | Prade | 114/357 |
| 4,781,136 | 11/1988 | Van Der Velden | 114/357 |
| 4,827,859 | 5/1989 | Powell | 114/357 |

*Primary Examiner*—Joseph F. Peters, Jr.
*Assistant Examiner*—Clifford T. Bartz
*Attorney, Agent, or Firm*—Ernest A. Beutler

[57] ABSTRACT

A catamaran construction formed from a molded fiberglass reinforced resin and a method for making it wherein the hull is comprised of a main hull and a pair of sponsons each affixed to the respective sides of the main hull. The main hull is formed from upper and lower portions, each of which contains the respective portion of the main hull and the sponsons, all integrally connected to each other.

5 Claims, 7 Drawing Sheets

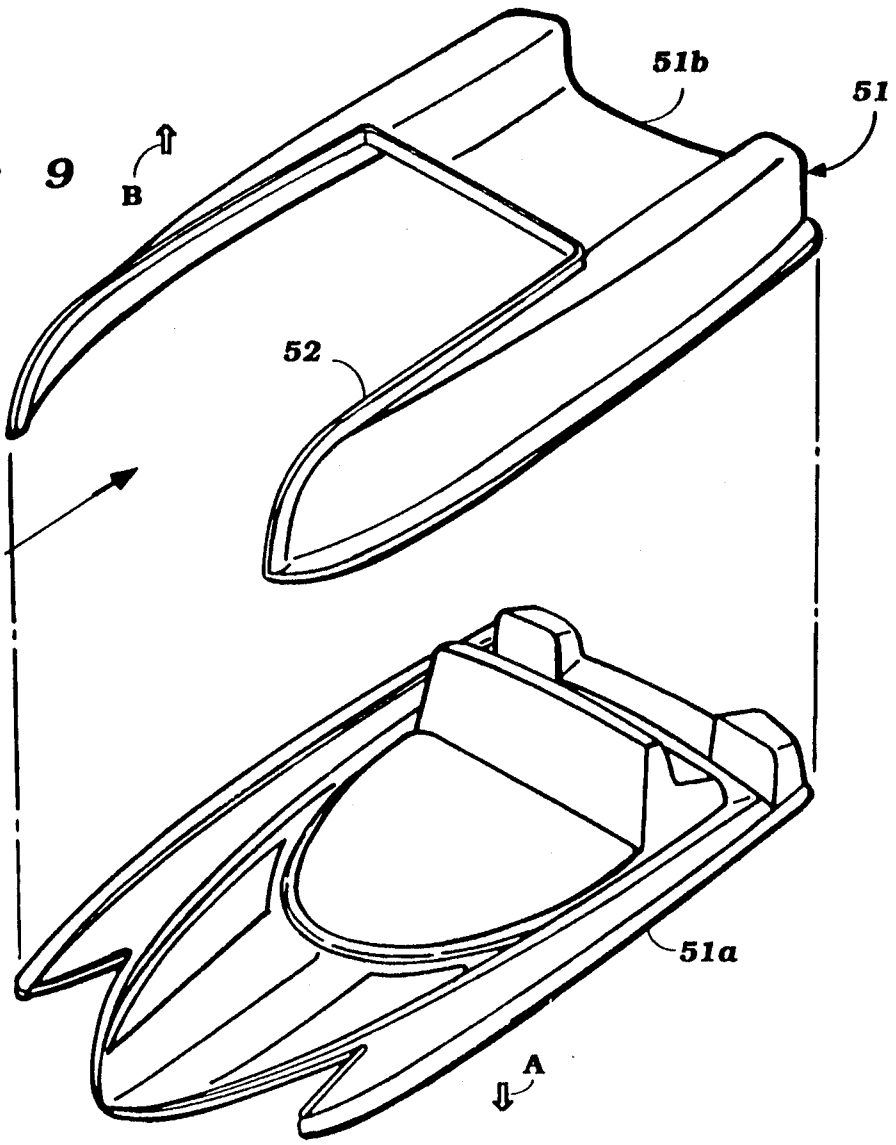
Figure 9
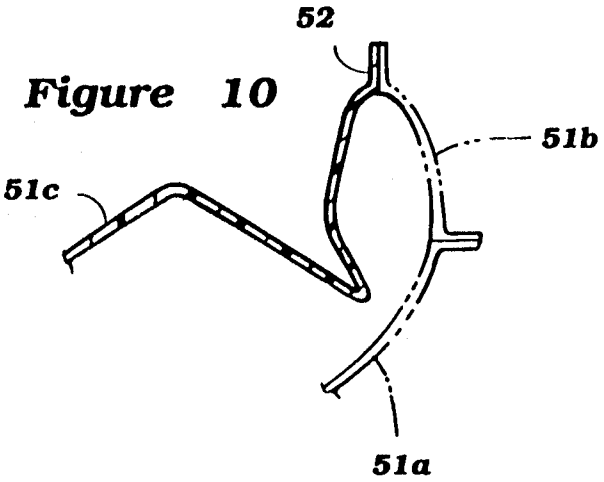
Figure 10
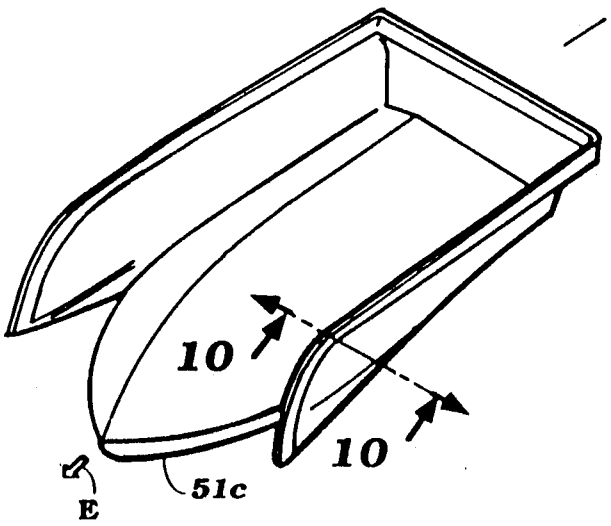

CATAMARAN

This is a continuation of U.S. patent application Ser. No. 472,619, filed Jan. 30, 1990 now abandoned.

BACKGROUND OF THE INVENTION

This invention relates to a catamaran and more particularly to an improved hull configuration for such a watercraft.

A very popular type of watercraft is a catamaran. Such watercraft conventionally have a main hull portion and a pair of sponsons that are connected to the main hull portion. Of course, it is desirable to form the hulls for such watercraft from materials such as molded fiberglass reinforced resins. With the hull configurations previously proposed, the sponsons, main hull and outriggers or connecting members must all be formed separately and then bonded to each other. This adds considerably to their cost and also can reduce the strength of the overall hull assembly.

It is, therefore, a principal object of this invention to provide an improved molded hull configuration for a catamaran that minimizes the number of parts that need be molded.

It is a further object of this invention to provide an improved method and apparatus for molding a hull for a catamaran that reduces the number of separate portions which must be molded.

SUMMARY OF THE INVENTION

This invention is adapted to be embodied in a molded hull construction for a catamaran having a main hull and a pair of sponsons each affixed to a respective side of the main hull. The hull is comprised of a lower section comprised of the lower portion of the main hull and the lower portions of the sponsons all integrally connected to each other and an upper section that is comprised of the upper portion of the main hull and the upper portions of the sponsons, all integrally connected to each other. The upper and lower hull sections are then secured together.

The invention is also adapted to be embodied in a method for making a molded hull configuration for a catamaran having a main hull and a pair of sponsons each affixed to a respective side of the main hull. The method comprises the steps of molding separate upper and lower sections each containing respectively the upper and lower portions of the main hull, the upper and lower portions of the sponsons all integrally connected to each other. The mold halves are then affixed to each other to form the completed hull.

BRIEF DESCRIPTIONS OF THE DRAWINGS

FIG. 9 is an exploded perspective view of another form of mold that can be utilized to form the hull of the configuration shown in FIGS. 1 through 6 and does not require inserts.

FIG. 10 is a cross sectional view taken along the line 10—10 of FIG. 9.

DETAILED DESCRIPTION OF THE PREFERRED EMBODIMENTS OF THE INVENTION

Figure 1:
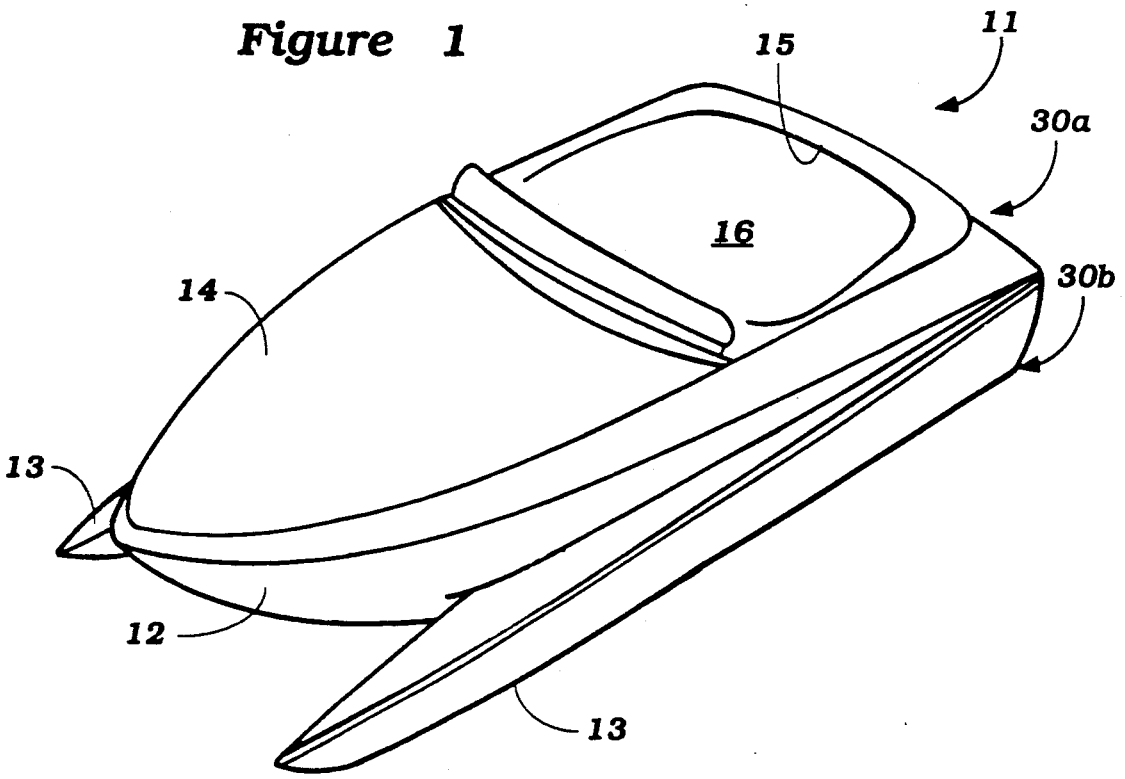
FIG. 1 is a perspective view of a catamaran taken from above, the front and one side.
Figure 2:
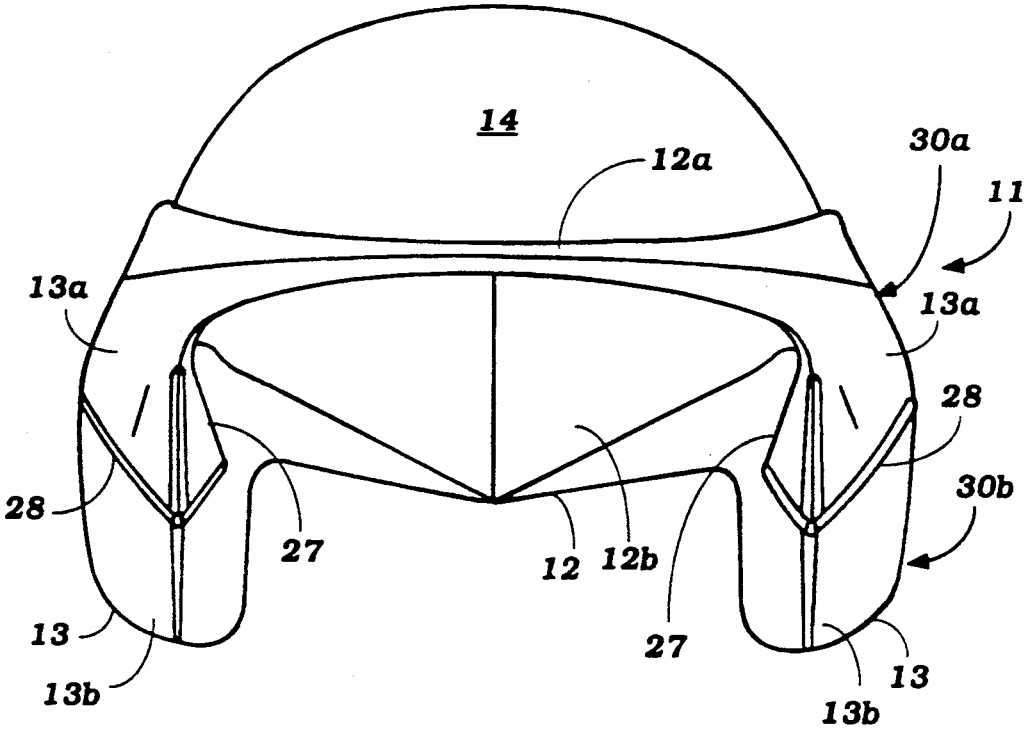
FIG. 2 is an enlarged front elevational view thereof.
Figure 3:
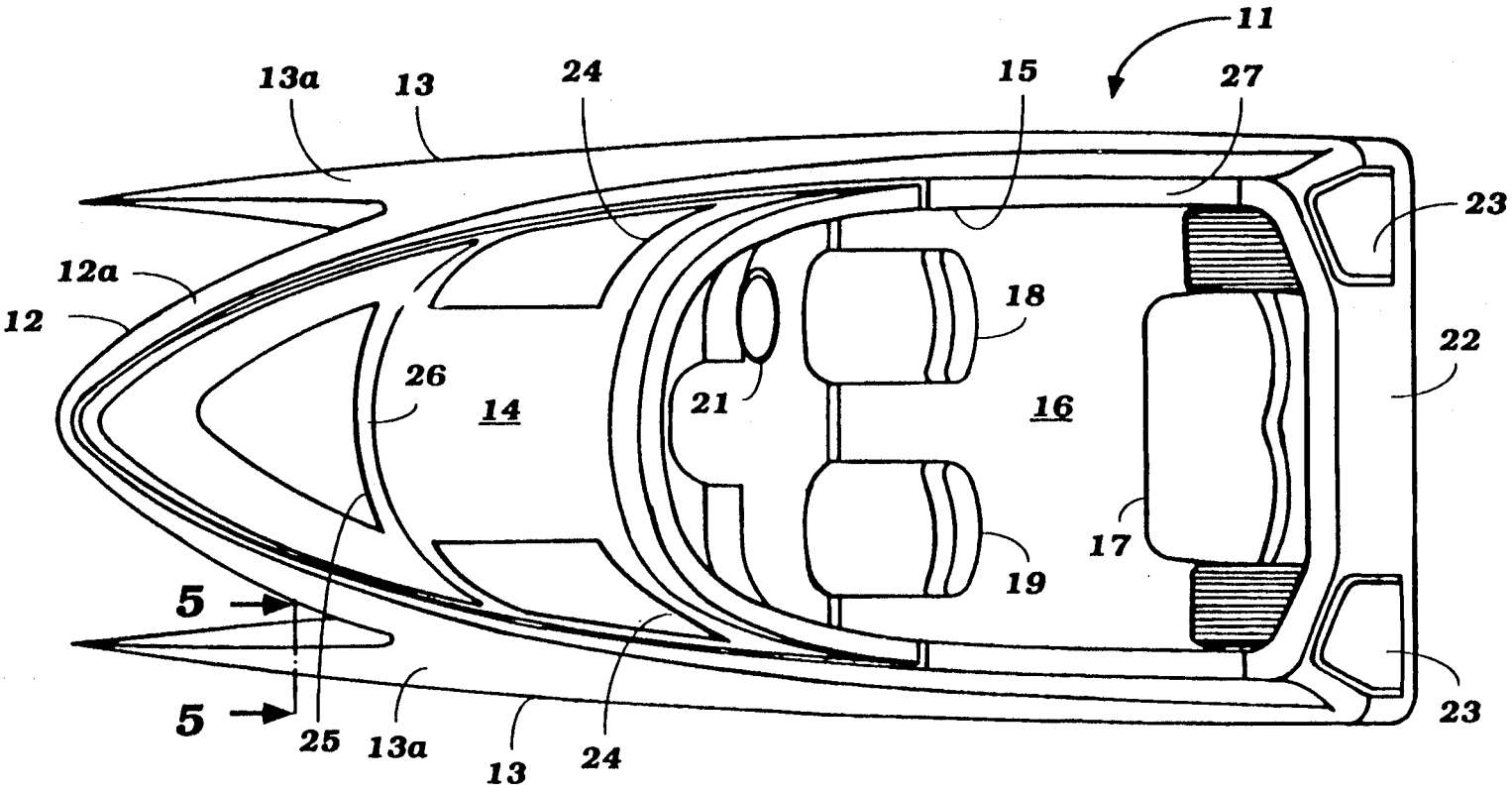
FIG. 3 is an enlarged top plan view thereof.
Figure 5:
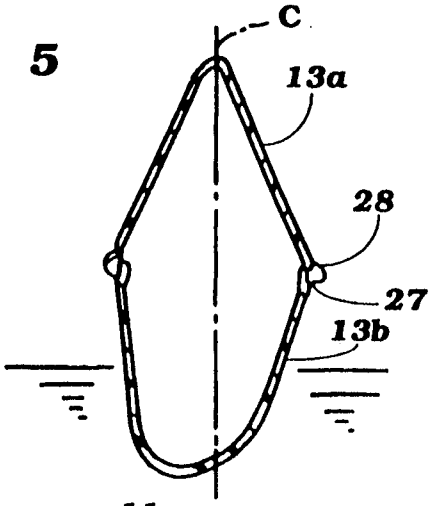
FIG. 5 is a cross sectional view taken along the line 5—5 of FIG. 3 and shows the cross section of one of the sponsons.
Figure 4:
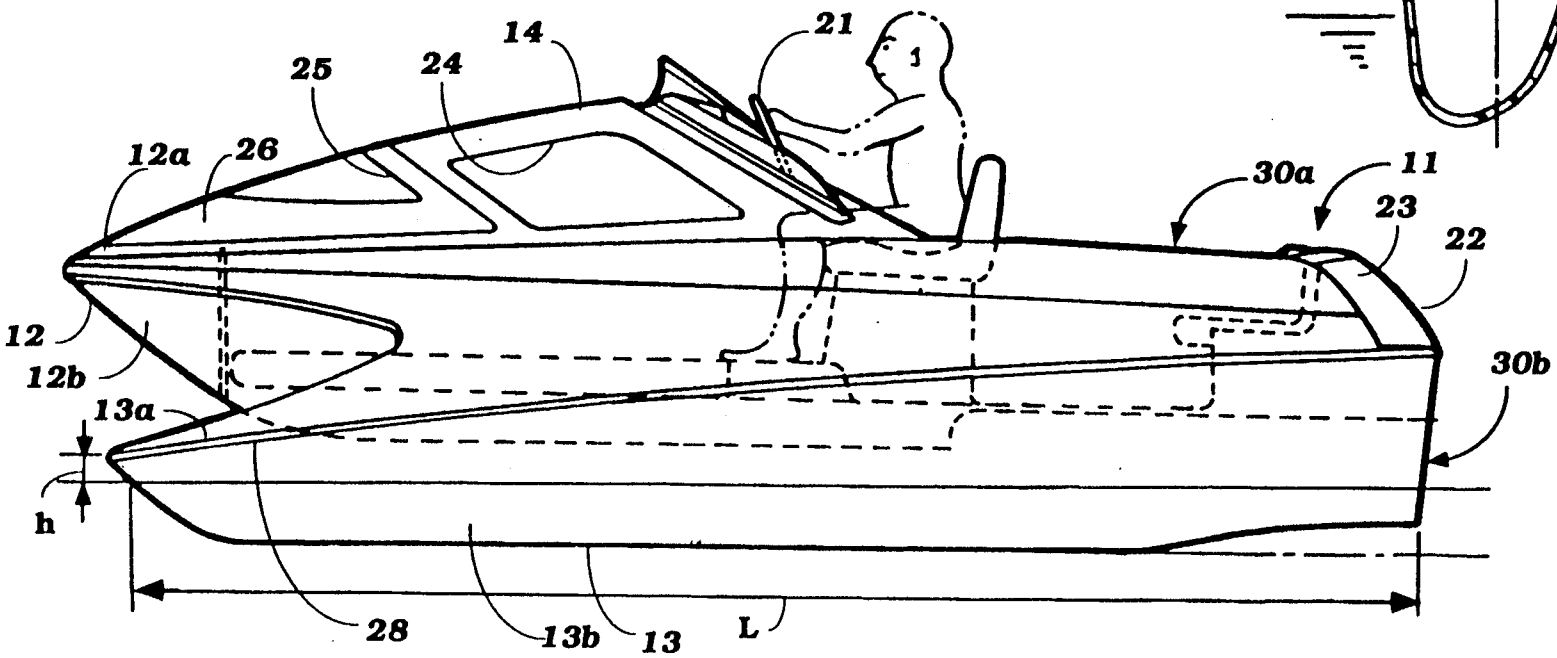
FIG. 4 is an enlarged side elevational view thereof.

Referring first to FIGS. 1 through 6, a catamaran constructed in accordance with an embodiment of the invention and made by a method embodying the invention is identified generally by the reference numeral 11. The catamaran 11 may generally have the attributes insofar as design of the sponsons and hull as set forth in our copending application of the same title, Ser. No. 472,316, filed Jan. 30, 1990 and assigned to the assignee of this application. Reference may be had to that application, which is incorporated hereby by reference, to the functional advantages of the construction as described therein.

Basically, the catamaran 11 is comprised of a main or central hull portion 12, a pair of sponsons 13, which are integrally connected to the main hull portion 12 in a manner to be described. The main hull portion 12 includes a deck 14 which may define a forward passenger compartment or cabin and which has a cavity 15 formed at its rear end that defines a passenger or rider compartment 16. A double rear seat 17 is positioned in the rider compartment 16 behind a driver's seat 18 and single passenger seat 19. A dash console and steering wheel 21 are provided at the front of the driver seat 18. It is to be understood, of course, that this configuration is only one of many that can be utilized in conjunction with the invention.

A transom 22 is provided at the rear of the passenger compartment 16 and is formed with a pair of wells 23 so as to accommodate outboard motors (not shown). Other forms of propulsion unit than outboard motor may be employed.

Figure 6:
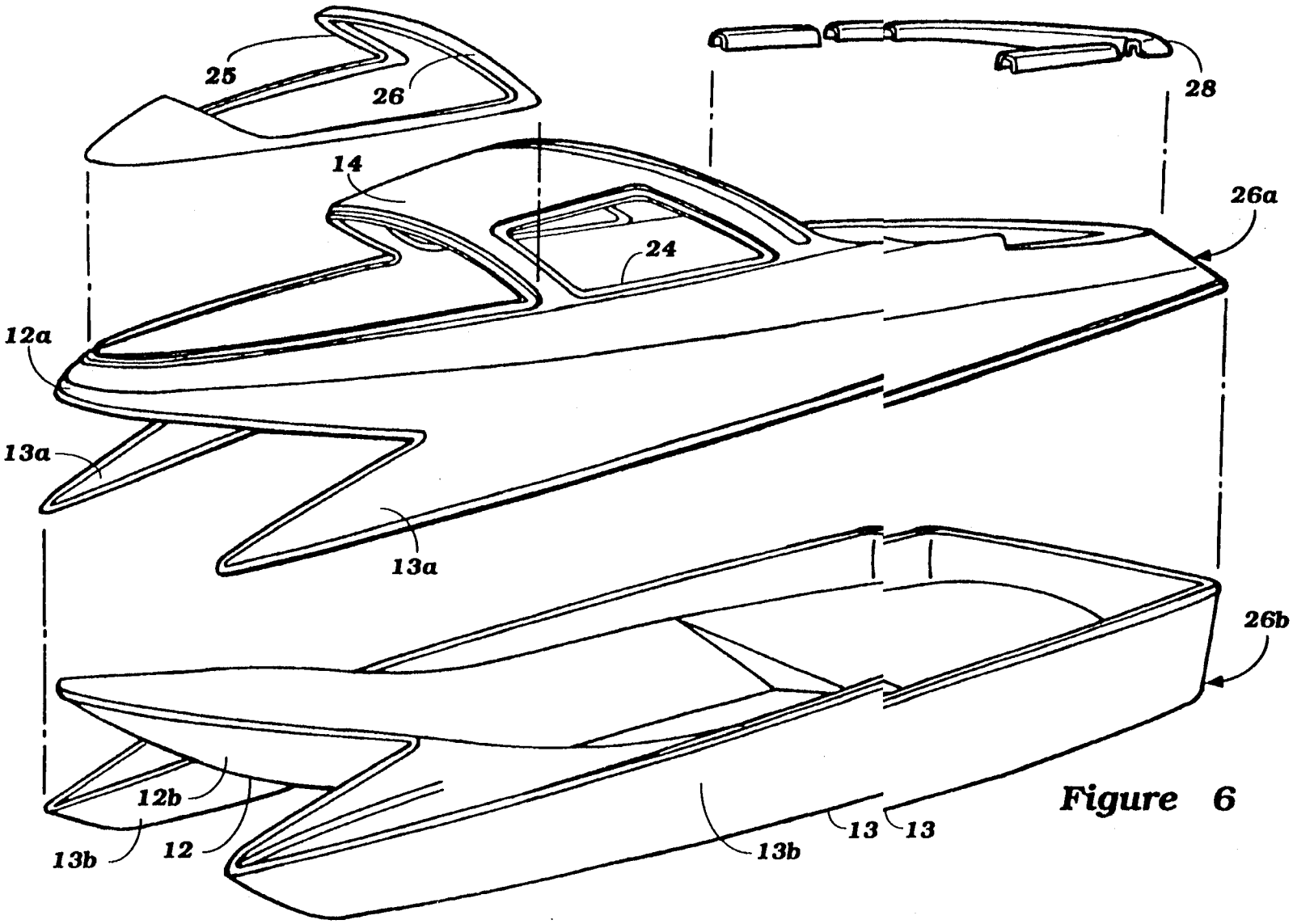
FIG. 6 is an exploded perspective view of the catamaran on a larger scale than FIG. 1.

The front cabin defined by the deck 14 may be provided with a plurality of windows comprised of side windows 24 and a front window 25. The windows 24 may be formed by a main portion of the deck 14 by cutouts therein, while the front window 25 may be formed from a separate insert 26 as best shown in FIG. 6. In addition, a separate rim assembly 27, which may be formed from one or more pieces, is affixed to the periphery of the rear portion of the rider compartment 16 and may form storage compartments.

In accordance with the invention, the lower portions of the sponsons 13 and main hull 12 are all formed as a single lower mold portion 30*b*. In a like manner, the top portion of the sponsons 13 and at least a portion of the upper deck 14 may be formed integrally from an upper portion 30*a*. The upper and lower halves of the individual components as thus far described have been identified by the same reference numerals with the suffixes a and b added.

It should be noted that the molded halves 30*a* and 30*b* have facing surfaces 27 and 28 which form the widest portion of the hull and which define the gunnels of the main hull 12 and particularly the sponsons 13.

It should be understood that the aforedescribed configuration is only one of many which may be utilized in conjunction with the invention. The invention relates primarily to the fact that the upper hull section and the lower hull section each are formed with the respective upper and lower portions of the main hull and the sponsons integrally connected to each other.

Figures 7, 8:
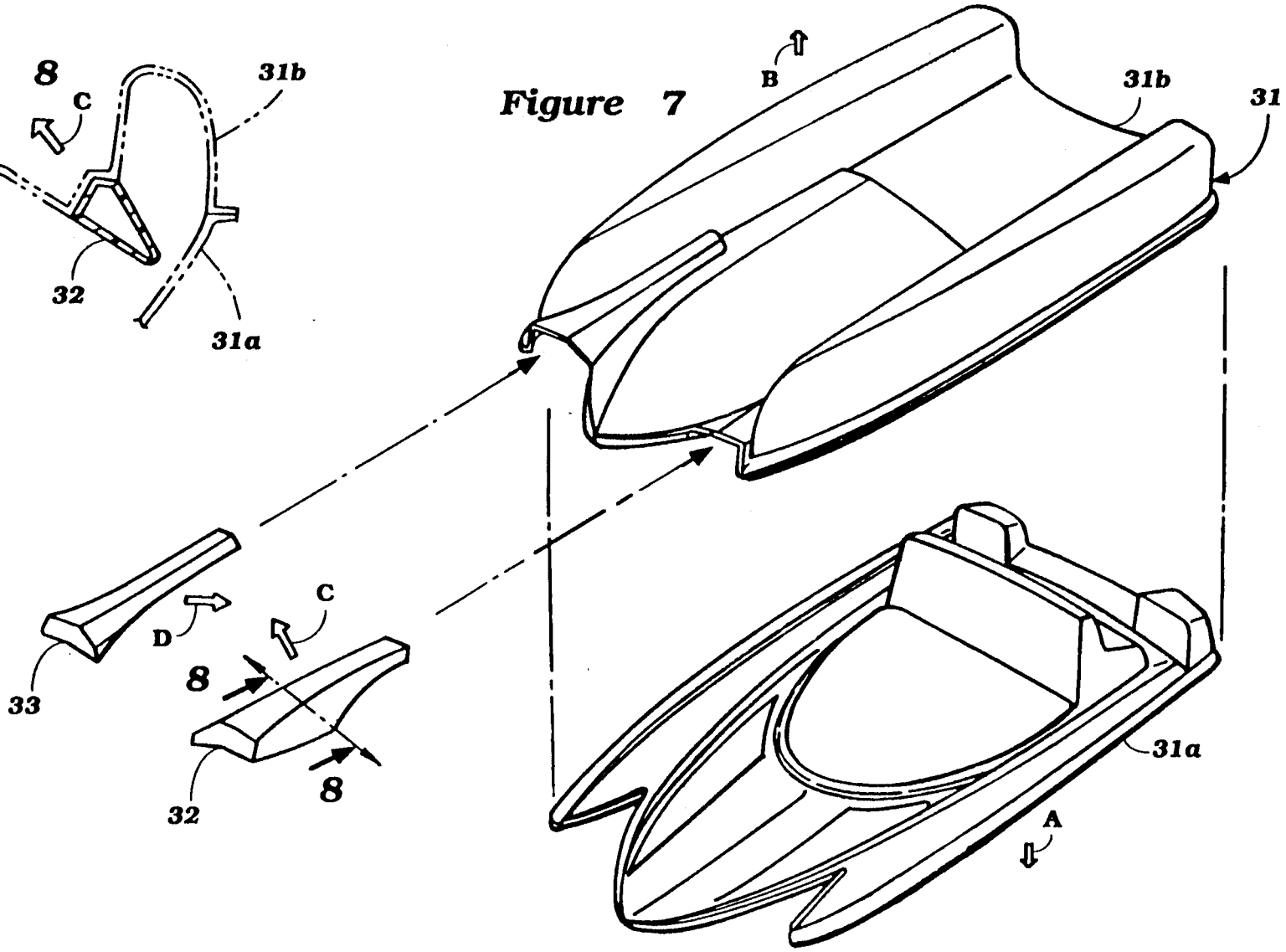
FIG. 7 is an exploded perspective view of the female mold halves and inserts utilized to form the hull of this embodiment.
FIG. 8 is a cross sectional view taken along the line 8—8 of FIG. 7 and shows how the mold inserts are positioned and removed.

The hull configuration as thus far described is constructed in a manner as may be best understood by reference to FIGS. 7 and 8. The material from which the hull is formed is a molded fiberglass reinforced resin or the like and which is formed in a female mold assembly, indicated generally by the reference numeral 31 comprised of a lower female mold half 31*b* and an upper female mold half 31*a*. It is to be understood that the upper and lower hull portions 30*a* and 30*b* are each laid up in the respective female mold portions 31*a* and 31*b*. There are also provided a pair of lower mold half inserts 32 and 33 which are utilized to form the deep recesses where the sponsons 13 are connected to the main hull 12. These mold inserts 32 and 33 are inserted as in the lower mold half 31 as best shown in the cross sectional view of FIG. 8.

After the upper and lower halves 30*a* and 30*b* have been laid up in the upper and lower mold sections 31*a* and 31*b* with the inserts 32 and 33 in place, the upper mold 31*a* is removed from the upper hull half 30*a* in the direction of the arrow A. The lower mold half 31*b* is removed from the lower half 30*b* in the direction of the arrow B. Once the main lower mold half 31*b* is removed, then the inserts 32 and 33 can be removed from the laid up lower hull section in the direction of the arrows C and D.

FIGS. 9 and 10 show another female mold configuration wherein inserts are not required. This mold assembly, indicated generally by the reference numeral 51 is comprised of an upper female mold half 51*a* and a lower female mold half comprised of a first portion 51*b* and a second portion 51*c*. The portions 51*b* and 51*c* are joined along a parting line 52 and thus can permit the laying up of the upper and lower hull sections without further inserts. The upper hull section is removed from the upper mold section 51*a* by removing the mold in the direction of the arrow A. In a like manner, the lower hull section is removed by first removing the mold half 51*b* in the direction of the arrow B and then the mold section 51*c* is removed in the direction o the arrow E.

Figure 11:
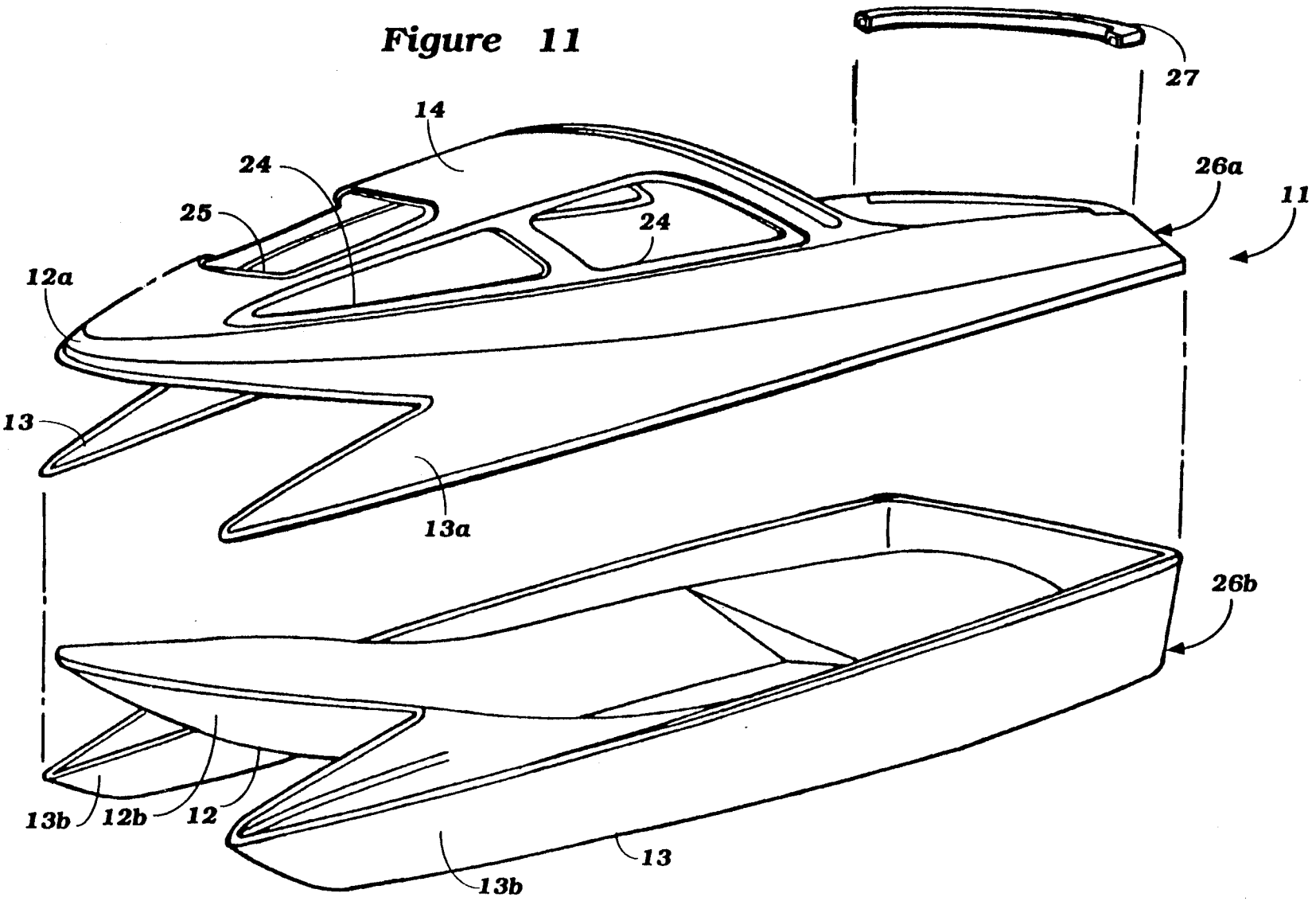
FIG. 11 is an exploded perspective view, in part similar to FIG. 6, showing another form of hull configuration.

FIG. 11 shows another embodiment of hull which is basically the same as that shown in FIGS. 1 through 6. In this embodiment, however, the windows 24 and 25 need not be formed by separate window members. Also, in this embodiment, the rim member 27 may be formed as a single piece. In addition, instead of just a single pair of side windows 24, there are provided two pairs of side windows. Since, in all other regards, this embodiment is the same as those previously described, the same reference numerals have been utilized to identify the same components. Further description is believed to be unnecessary.

It should be readily apparent from the foregoing description that the embodiments of the invention described permit the formation of a catamaran hull from molded fiberglass reinforced resin in a very simple and convenient manner. In addition, the resulting watercraft will have great strength and can be made at a low cost. Of course, the embodiments of the invention described are merely examples. Various changes and modifications may be made without departing from the spirit and scope of the invention, as defined by the appended claims.

We claim:

1. A molded fiberglass reinforced resin hull construction for a catamaran having a main hull having a V bottom and defining a passenger's compartment and a pair of sponsons each affixed to a respective side of said main hull, said hull being comprised of a shell like lower section comprised of the lower portion of said main hull and the lower portions of said sponsons, all integrally connected to each other, a shell like upper section comprised of the upper portion of said main hull and the upper portions of said sponsons, all integrally connected to each other, and means for securing the upper and lower sections to each other around their peripheral edges.

2. A molded hull construction as set forth in claim 1 wherein the upper and lower sections are secured to each other by bonding around their outer periphery.

3. A molded hull construction as set forth in claim 2 wherein the upper and lower sections are bonded to form gunnels extending at the maximum dimension portion of the respective upper and lower sections.

4. A method of forming a molded hull construction for a catamaran having a main hull and a pair of sponsons each affixed to a respective side of the main hull comprising the steps of molding a lower hull section comprised of the lower portion of the main hull and the lower portions of the sponsons all integrally connected to each other, molding an upper hull section comprised of the upper portion of the main hull and the upper portions of the sponsons, all integrally connected to each other and connecting the upper and lower hull portions to each other, at least one of the hull portions being formed by a mold having removable inserts.

5. A method of forming a molded hull construction for a catamaran having a main hull with a V bottom and a pair of sponsons each affixed to a respective side of the main hull comprising the steps of molding a lower hull section shell comprised of the lower portion of the main hull and the lower portions of the sponsons all integrally connected to each other, molding an upper hull section shell comprised of the upper portion of the main hull and the upper portions of the sponsons, all integrally connected to each other and connecting the upper and lower hull shell portions to each other around their peripheral edges to form a hollow structure between the upper and lower hull shell portions.

* * * * *